United States Patent [19]

Hayashi et al.

[11] Patent Number: 4,887,921

[45] Date of Patent: Dec. 19, 1989

[54] DOT PRINTER HAVING MEANS FOR DISCHARGING STATIC ELECTRICITY FROM THE INK RIBBON

[75] Inventors: Mikio Hayashi; Fumio Otsuka, both of Tokyo, Japan

[73] Assignee: Seikosha Co., Ltd., Tokyo, Japan

[21] Appl. No.: 559,950

[22] Filed: Dec. 9, 1983

[30] Foreign Application Priority Data

Dec. 10, 1982 [JP] Japan ..... 57-217283

[51] Int. Cl.[4] ..... B41J 32/02

[52] U.S. Cl. ..... 400/196.1; 400/202.4; 400/352; 400/693.1; 361/212

[58] Field of Search ..... 400/196.1, 208, 202.4, 400/350, 352, 353, 354, 691, 692, 693, 694, 693.1; 361/220, 214, 212; 242/194, 197, 199

[56] References Cited

U.S. PATENT DOCUMENTS

| | | | |
|---|---|---|---|
| 2,483,542 | 10/1949 | Hooper | 361/214 |
| 3,601,654 | 9/1971 | Long | 361/212 |
| 3,636,408 | 1/1972 | Shuman | 361/212 |
| 3,857,532 | 12/1974 | Bastiaans | 361/212 |
| 4,071,133 | 1/1978 | Scherer et al. | 400/202.4 |
| 4,347,549 | 8/1982 | Fechner | 361/212 |
| 4,351,619 | 9/1982 | Duke et al. | 400/196.1 |
| 4,389,126 | 6/1983 | Honma et al. | 400/124 |
| 4,407,543 | 10/1983 | Haftmann | 400/208 |
| 4,418,371 | 11/1983 | Menden | 400/354 |
| 4,451,166 | 5/1984 | Frechette et al. | 400/234 |
| 4,452,542 | 6/1984 | Akazawa | 400/354 |

FOREIGN PATENT DOCUMENTS

| | | | |
|---|---|---|---|
| 48206 | 6/1982 | Japan | 400/196.1 |
| 57-148682 | 9/1982 | Japan | 400/694 |

*Primary Examiner*—David B. Wiecking

*Attorney, Agent, or Firm*—Bruce L. Adams; Van C. Wilks

[57] ABSTRACT

An inpact dot printer has a ribbon cassette the casing of which is made of plastic. A leaf spring is mounted in the casing so as to be resilient contact with the inked ribbon in the cassette. An element protrudes from the spring to the outside of the casing, and is located at a position where it is in resilient contact with either a carriage of conductive material or a metal part secured to the carriage when the ribbon cassette is installed in position on the carriage. When the printer effects printing operation, static electricity generated on the ribbon is carried away to ground via the protruding element and other components.

19 Claims, 2 Drawing Sheets

DOT PRINTER HAVING MEANS FOR DISCHARGING STATIC ELECTRICITY FROM THE INK RIBBON

FIELD OF THE INVENTION

The present invention relates to an impact dot printer in which a carriage carrying a printing head is slidably supported by guide shafts, and in which a ribbon cassette is mounted on the carriage in such a manner as to embrace the head.

BACKGROUND OF THE INVENTION

As is well known, in an impact dot printer, a printing hammer or wire forces an inked ribbon to strike a printing paper at a quite high velocity to perform printing. During this operation, the ribbon and the paper rub against each other momentarily and repeatedly, producing static electricity on the ribbon. In case of a ribbon cassette, the casing is made of plastic, and therefore the static electricity generated on the ribbon can escape to nowhere, thus tending to build up. Eventually, a discharge will occur between the ribbon and the front surface of the head, the printing hammer or wire. This sometimes may cause a malfunction of the printer.

SUMMARY OF THE INVENTION

Accordingly, it is the main object of the present invention to provide a printer which is capable of preventing accumulation of static electricity on the inked ribbon in a ribbon cassette, whereby preventing the printer from malfunctioning due to discharge of electricity.

It is a more specific object of the invention to provide a printer which is equipped with a means for carrying away static electricity generated on the ribbon cassette to ground.

DETAILED DESCRIPTION OF THE INVENTION

Figure 1:
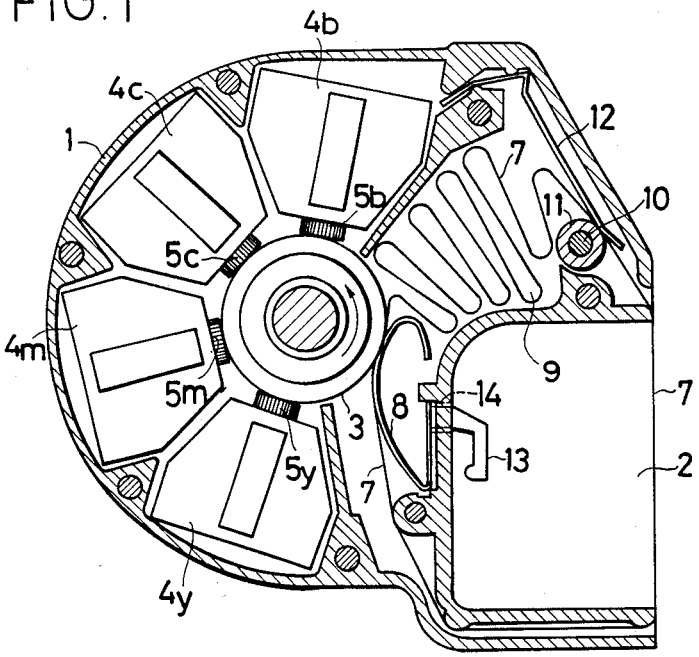
FIG. 1 is a cross-sectional view of a ribbon cassette in a printer according to the invention, for showing the internal structure of the cassette.
Figure 2:
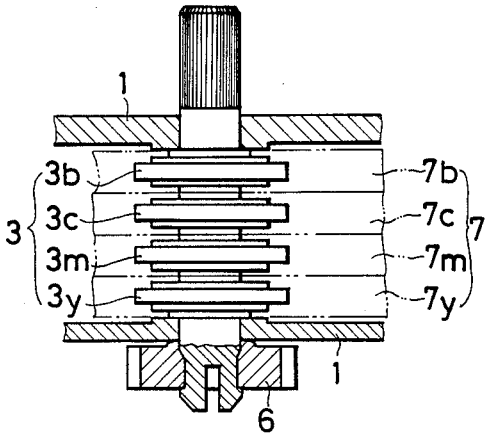
FIG. 2 is a cross-sectional view of the feed roller of the printer.

Referring first to FIG. 1, there is shown a ribbon cassette used in a printer according to the present invention. The case 1 of the cassette is provided with a recess 2 to receive a printing head (described later). An ink transfer or feed roller 3 is rotatably supported at the center of the case 1. Four ink cartridges 4*b*, 4*c*, 4*m* and 4*y* impregnated with block, cyan, magenta and yellow inks, respectively, are radially disposed around the roller 3. As shown in FIG. 2, the ink transfer or feed roller 3 has four protruding transfer rings or surfaces 3*b*, 3*c*, 3*m* and 3*y* which are formed in a coaxial relation. The ink cartridges include ink wicks 5*b*, 5*c*, 5*m* and 5*y* opposed to the respective transfer surfaces. Springs (not shown) are pressed against the rear sides of the cartridges 4*b*, 4*c*, 4*m* and 4*y* so that the wicks 5*b*, 5*c*, 5*m* and 5*y* may be in resilient contact with the respective transfer surfaces 3*b*, 3*c*, 3*m* and 3*y*. The stem of the feed roller 3 protrudes from the lower surface of the case 1, and a toothed wheel 6 is firmly secured to the protruding end of the stem. As shown in FIG. 2, an inked ribbon 7 is longitudinally sectioned into four color strips 7*b*, 7*c*, 7*m* and 7*y* which are brought into resilient contact with the transfer surfaces 3*b*, 3*c*, 3*m* and 3*y*, respectively, by a metal leaf spring member 8 (FIG. 1). The ribbon 7 constitutes an endless belt most of which is received in a ribbon chamber 9 in a zigzag form. When the roller 3 is rotated in a counter-clockwise direction (FIG. 1), the ribbon 7 is fed into the chamber 9. At the same time, the ribbon 7 is taken out from the chamber 9. A pass roller 11 is supported near the exit from the chamber 9 for the ribbon 7 by a shaft portion integral with the case 1. The ribbon 7 is pressed on the roller 11 by means of a spring 12. Accordingly, when the ribbon 7 is pulled out from the chamber 9, a load is imparted to the ribbon 7, whereby an appropriate tension is given to the ribbon 7 pulled out in front of the recess 2. The leaf spring member 8 pressing the ribbon 7 against the roller 3 is provided with a protruding element 13 having an integral relation with the spring. The element 13 protrudes into the recess 2 through an opening 14 formed in a portion of the case 1.

Figure 4:
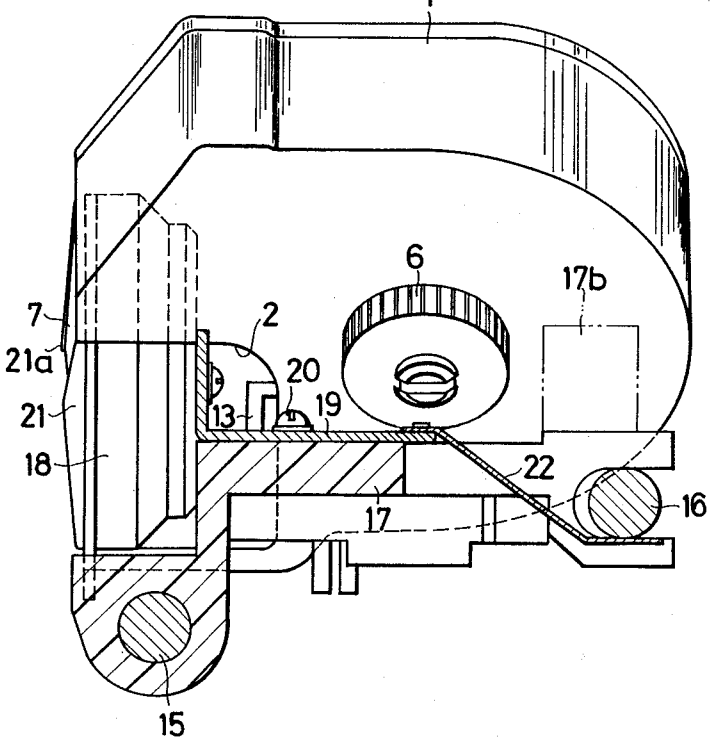
FIG. 4 is a cross-sectional view partially in section of the printer.
Figure 3:
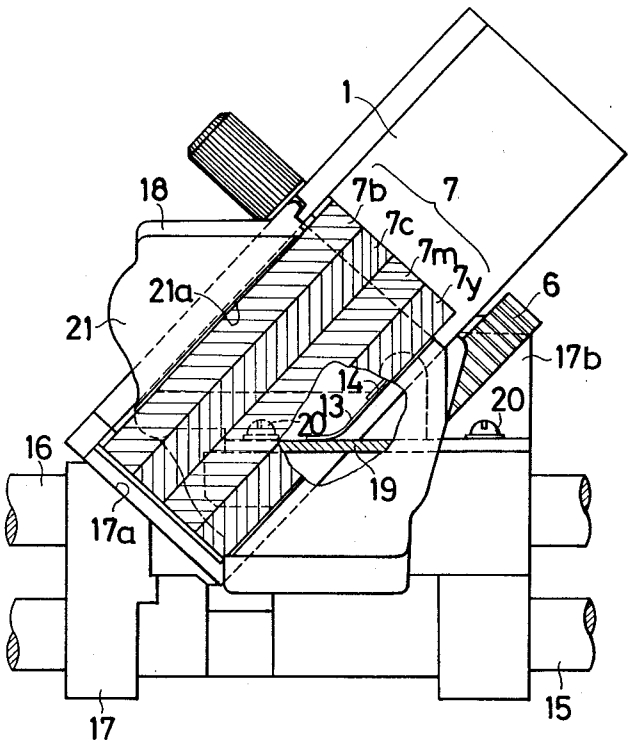
FIG. 3 is a front elevation of the printer under the condition where the ribbon cassette is installed in position.

FIGS. 3 and 4 show the manner in which the above-mentioned ribbon cassette is installed in a predetermined working position. A carriage 17 made of plastic is supported by guide shafts 15 and 16 so as to be slidable therealong. A plate 19 which supports a printing head 18 is firmly secured to the upper surface of the carriage 17 by screws 20. The cassette is positioned at an angle relative to the head 18 through the use of support bases 17*a* and 17*b* on the carriage 17. Under this condition, the printing head 18 is received in the recess 2, and the ribbon 7 is inserted in an obliquely extending guide groove 21*a* which is formed in a ribbon guide member 21 composed of plastic. The guide member 21 is disposed on the front surface of the printing head 18. In FIG. 3, printing hammers (not shown) provided in the printing head 18 are opposed to the color strips

7*b*, 7*c*, 7*m* and 7*y* of the ribbon 7. The toothed wheel 6 engages with a driving wheel (not shown) which is horizontally held on the upper surface of the carriage 17. When the carriage 17 is moved, the wheel 6 is driven via the driving wheel, thereby rotating the roller 3 counterclockwise as viewed in FIG. 1. Under this condition, the protruding element 13 is in resilient contact with the upper surface of the support plate 19, to which one end of a protruding spring 22 is securely fixed, the other end being in resilient contact with the guide shaft 16.

Accordingly, when static electricity is generated on the ribbon 7 by a printing operation, this electricity is carried away to a side plate (not shown), to which the shafts 15, 16 are securely fixed, by a conductive path comprised of the protruding element 13 of the spring 8 in contact with the ribbon 7 via the plate 19, spring 22 and shaft 16. In this manner, the plate 19 comprises a connecting member for electrically connecting the leaf spring 8 to the leaf spring 22.

It is to be noted that various modifications may be made to the aforementioned construction for connecting the support plate 19 to ground. For example, a further lead wire may be added to the signal cable (not shown) used for the head 18 for grounding purposes only. One end of this additional wire may be connected to the support plate 19, while the other end may be connected to ground, e.g. the side plate. In the case where the carriage 17 is made of an electrically conductive material such as aluminum by die casting, it turns out that the carriage 17 itself is grounded via the shafts 15 and 16. Therefore, it is not necessary to provide the spring 22 and the additional lead wire. In this case, it is possible to put the protruding element 13 of the spring 8 into direct contact with a portion of the carriage 17. Additionally, in the above embodiment, the leaf spring 8 acts to press the ribbon 7 against the feed roller 3. It is also possible to form a protruding element on another component such as the spring 12 to serve the same purpose as the protruding element 13. Further, a leaf spring serving grounding purposes only may be disposed at an appropriate position in the case 1 so as to be in contact with the ribbon 7.

According to the novel printer described thus far, accumulation or static electricity on the inked ribbon can be prevented in a simple manner, and therefore a discharge of electricity between the ribbon and the printing head can be circumvented, whereby avoiding malfunction of the printer and enhancing the reliability.

Obviously many modifications and variations of the present invention are possible in the light of the above teachings. It is therefore to be understood that within the scope of the appended claims the invention may be practiced otherwise than as specifically described.

What is claimed is:

1. In a dot printer including a printing head connected by means of a conductive supporting plate to a carriage slidably received on guide shafts, and a ribbon cassette having a case which contains an ink ribbon and being installed in a predetermined position on said carriage, the improvement comprising: means for electrically grounding said supporting plate; and a conductive leaf spring disposed within said case of said ribbon cassette so as to be in resilient contact with said ink ribbon, said leaf spring having an integral protruding element which extends toward the exterior of said case and which is in resilient contact with said supporting plate so as to discharge static electricity generated on said ribbon to side supporting plate.

2. In a dot printer as claimed in claim 1; in which said carriage is composed of an electrically insulating material.

3. In a dot printer as claimed in claim 2; in which said grounding means comprises at least one of said guide shafts, and a second leaf spring one end of which is secured to said supporting plate and the other end of which is in resilient contact with one of said guide shafts.

4. In a dot printer as claimed in claim 1; in which said grounding means comprises said carriage and at least one of said guide shafts which are made of electrically conductive materials.

5. In a dot printer as claimed in claim 1; in which said ribbon cassette has an endless inked ribbon, an ink transfer roller, and said leaf spring is positioned to effectively press said inked ribbon into contact with said roller.

6. In a dot printer of the type having a carriage slidable along guide shafts and carrying a printing head connected by means of an electrically conductive connecting member to the carriage and carrying a ribbon cassette removably mounted in a predetermined working position on the carriage, the ribbon cassette containing a lengthwise advanceable ink ribbon which coacts with the printing head during use of the dot printer to perform a printing operation accompanied by the generation of static electricity on the ink ribbon: means defining an electrically conductive path for electrically grounding said connecting member; and an electrically conductive spring member disposed within the ribbon cassette in resilient sliding contact with the ink ribbon and having a protruding resilient part thereof in resilient and electrical contact with said connecting member to effect the discharge of static electricity from the ink ribbon to ground via said connecting member.

7. A dot printer according to claim 6; wherein the electrically conductive path includes one of said guide shafts, the one guide shaft being composed of electrically conductive material.

8. A dot printer according to claim 7, wherein the electrically conductive path further includes a second electrically conductive spring member electrically and mechanically connected to said connecting member and having a resilient part thereof in electrical and resilient sliding contact with the said one guide shaft.

9. A dot printer according to claim 8; wherein both electrically conductive spring members comprise leaf springs.

10. A dot printer according to claim 8; wherein the ribbon cassette contains therein a rotatable transfer roller, and means for supplying ink to the transfer roller, and wherein the spring member disposed within the ribbon cassette includes means for resiliently pressing the ink ribbon into contact with the transfer roller to enable the ink to be transferred from the transfer roller to the ink ribbon during use of the dot printer.

11. A dot printer according to claim 10; wherein the ink ribbon has a plurality of longitudinally extending strips impregnated with inks of different colors, the transfer roller has a plurality of separate transfer rings in contact with respective ones of the strips, and the means for resiliently pressing the ink ribbon comprises means for resiliently pressing the differently colored ink ribbon strips into contact with respective ones of the transfer roller rings.

12. A dot printer according to claim 11; wherein the means for resiliently pressing the ink ribbon comprises a curved resilient part of the spring member.

13. A dot printer according to claim 11; wherein said connecting member comprises means for supporting the printing head on the carriage.

14. A dot printer according to claim 6; wherein the ribbon cassette contains therein a rotatable transfer roller, and means for supplying ink to the transfer roller, and wherein the spring member disposed within the ribbon cassette includes means for resiliently pressing the ink ribbon into contact with the transfer roller to enable the ink to be transferred from the transfer roller to the ink ribbon during use of the dot printer.

15. A dot printer according to claim 14; wherein the ink ribbon has a plurality of longitudinally extending strips impregnated with inks of different colors, the transfer roller has a plurality of separate transfer rings in contact with respective ones of the strips, and the means for resiliently pressing the ink ribbon comprises means for resiliently pressing the differently colored ink ribbon strips into contact with respective ones of the transfer roller rings.

16. A dot printer according to claim 15; wherein the means for resiliently pressing the ink ribbon comprises a curved resilient part of the spring member.

17. A dot printer according to claim 15; wherein said connecting member comprises means for supporting the printing head on the carriage.

18. A dot printer according to claim 6; wherein said connecting member comprises means for supporting the printing head on the carriage.

19. A dot printer according to claim 6; wherein the spring member comprises an integral leaf spring structure.

* * * * *